US005487415A

United States Patent [19]

Maina

[11] Patent Number: 5,487,415

[45] Date of Patent: Jan. 30, 1996

[54] WEFT FEEDER WITH RETHREADING AND BRAKING DEVICES

[75] Inventor: Bruno Maina, Vigliano Biellese, Italy

[73] Assignee: Roj Electrotex S.p.A., Biella, Italy

[21] Appl. No.: 211,123

[22] PCT Filed: Apr. 13, 1992

[86] PCT No.: PCT/EP92/00834

§ 371 Date: May 23, 1994

§ 102(e) Date: May 23, 1994

[87] PCT Pub. No.: WO/9306277

PCT Pub. Date: Apr. 1, 1993

[30] Foreign Application Priority Data

Sep. 19, 1991 [IT] Italy ..... VC91U0010

[51] Int. Cl.[6] ..... D03D 47/34

[52] U.S. Cl. ..... 139/452; 139/450; 139/194; 242/47.01; 242/149

[58] Field of Search ..... 139/452, 450, 139/194; 242/47.01, 149, 419.3

[56] References Cited

U.S. PATENT DOCUMENTS

| | | | |
|---|---|---|---|
| 5,109,891 | 5/1992 | Maina | 139/452 X |
| 5,123,455 | 6/1992 | Maina | 139/452 |
| 5,181,544 | 1/1993 | Deiuri | 139/452 |
| 5,368,244 | 11/1994 | Melillo et al. | 242/149 |

FOREIGN PATENT DOCUMENTS

| | | | |
|---|---|---|---|
| 0239055 | 9/1987 | European Pat. Off. | 139/452 |

*Primary Examiner*—Andy Falik
*Attorney, Agent, or Firm*—Young & Thompson

[57] ABSTRACT

A weft feeder for gripper or projectile looms allows an operator promptly to restore the continuity of a weft yarn from a yarn feed spool to members for weft insertion into a loom shed, in case of weft yarn breakage or interruption. Downstream of a first yarn guide outlet, there are mounted a double-leaf brake, a separating element, and a second downstream yarn guide eyelet. The separating element is controlled by an actuator so as to separate two brake leaves of the double-leaf brake and to form a duct to guide the weft yarn from the first eyelet to the second eyelet.

4 Claims, 6 Drawing Sheets

WEFT FEEDER WITH RETHREADING AND BRAKING DEVICES

BACKGROUND OF THE INVENTION

1. Field of the Invention

The present invention concerns improvements in weft feeders for gripper or projectile looms, allowing an operator promptly to restore the continuity of the weft yarn from the yarn feed spool or reel to the members for weft insertion into the loom shed, in case of yarn breakage or interruption.

2. Description of the Related Art

In most cases, in the event of yarn breakage, it is necessary to introduce a new weft yarn into the weft feeder, that is, to perform a series of operations by which the free weft yarn end, fed from the spool or reel, is guided into the various passages provided therefor in the weft feeder, so as to be then readily introduced into the loom weft insertion members.

FIG. 1 of the accompanying drawings shows the prior art weft feeder configuration to which reference is made in the description given hereinafter of the invention. The weft yarn 1, drawn from the spool 2, is guided through an eyelet 3 into the inner cavity of the winding arm 5 which, moved by an electric motor 4, winds it up into even turns around the winding unit or drum 6. The weft yarn 1 is then unwound from said drum 6 in an axial direction—drawn by the loom weft insertion members—and it is braked by known type brake means, consisting of a ring 7 carrying an annular brush 8, whose bristles press—with an adjustable pressure—against the round-shaped periphery of the drum 6. The weft yarn 1 is finally let out through a guide eyelet 10, centered on the drum axis and carried by a radial bracket 9 positioned alongside the drum 6. Downstream of the yarn guide eyelet 10, use is often made—to improve and complete the action of the annular brush brake 8—of a double-leaf brake 21, and/or of a weft tension device 31, comprising an oscillating lever, useful especially in gripper looms; both these devices—known per se—are carried by the same bracket 9 and are positioned in alignment with the eyelet 10 on the drum axis.

According to conventional technique, the previously described operation of introducing a new weft yarn into the weft feeder is carried out manually—with the help of a flexible threading hook which, as known, consists of a strip of flexible material ending with a slot or hook—and it is a rather long and toilsome operation which also requires a certain experience. Several expedients have so far been adopted to facilitate the insertion of a new weft yarn by means of a threading hook, for instance forming guides of various types allowing a quicker and safer introduction of the threading hook, as described for example in DE-2932782 and in EP-285592: according to this latter, the threading hook is used to insert the weft yarn also in the double-leaf brake and in weft tension device.

In the attempt to make the above operation more automatic, it has more recently been proposed to introduce a new weft yarn into the weft feeder by means of compressed air jets, as described for example in DE-G-8712946, wherein successive yarn launching and guiding devices are provided to insert the yarn into the various passages, without the help of a threading hook. The most critical and difficult part is however the pneumatic introduction of the yarn into the guide eyelet 10, at the outlet of the weft feeder, in that very sharp deviations have to be imparted on the yarn in order to guide it from the drum periphery into said eyelet 10.

According to EP-A1-436900, filed by the Applicant the introduction of the yarn into the guide eyelet 10 is efficiently obtained by positioning said eyelet along the rectilinear trajectory of the yarn coming out from a duct provided downstream of the winding arm, and by simultaneously removing the annular brush brake from its working position, so that the yarn, passing through the ring 7 of said brake, is then introduced into the eyelet 10. This system fully solves the above problem, but it supplies a solution which forms part of a totally automatic system to restore the continuity of the weft yarn from the spool to the loom; furthermore, it does not consider introducing the yarn into any additional devices—such as the double-leaf brake and the weft tension device—which, as already said, may often be provided (especially in gripper looms) downstream of the yarn guide eyelet 10, at the outlet of the weft feeder.

OBJECT AND SUMMARY OF THE INVENTION

The object of the present invention is to provide a solution which can be applied to partially automatic systems and which allows an operator, at the same time, to introduce the weft yarn into said additional devices at the outlet of the weft feeder. According to the invention, this object is reached with a weft feeder for gripper or projectile looms comprising: a body housing a motor; a drum mounted on the motor shaft and held stationary, around which a winding arm rotated by the motor winds up a weft yarn reserve; an extension of body carrying sensors to detect and control the yarn reserve being wound on the drum, as well as brake means, in the form of a ring with an annular brush, apt to brake the weft yarn against the end surface of the drum; pneumatic means to restore the continuity of the weft yarn from the feed spool to the loom, in case of yarn breakage or interruption, comprising at least one compressed air nozzle device positioned at the inlet of the weft feeder so as to introduce therein a new yarn fed from a spool or reel; and yarn launching and guiding means to introduce the yarn into a yarn guide eyelet, centered on the drum axis, at the outlet of the weft feeder. In said weft feeder:

said outlet yarn guide eyelet is mounted on a movable support, so as to be shifted from the drum axis and be caused to intersect the yarn trajectory—determined by said compressed air nozzle device—at the outlet from the inner cavity of the winding arm, said winding arm being stopped in a preset angular position and the ring of the annular brush brake being provided with an outwardly flared radial notching in the same angular position;

downstream of said outlet yarn guide eyelets there is mounted a double-leaf brake comprising an end eyelet, as well as an element apt to open the two leaves apart, under the control of an actuator, so as to form a duct for the yarn between said two leaves;

downstream of said outlet yarn guide eyelet, there is mounted a weft tension device comprising an oscillating lever, positioned between said outlet yarn guide eyelet and an end yarn guide eyelet, and moving between a working position and a neutral position of weft insertion;

downstream of said outlet yarn guide eyelet, there are mounted, in succession, both a double-leaf brake comprising an element opening the two leaves apart, and a weft tension device comprising an oscillating lever, an intermediate yarn guide eyelet being provided between said brake and said tension device and this latter device being in turn followed by an end yarn guide eyelet, said oscillating lever being controlled by said opening element of the double-leaf brake, which is in turn controlled by a pneumatic or electromechanical actuator.

A compressed air device, consisting of a yarn suction nozzle, can moreover be mounted just after said outlet yarn guide eyelet.

When the outlet yarn guide eyelet is mounted on a movable support, so as to be shifted from the drum axis and be caused to intersect the yarn trajectory at the outlet from the inner cavity of the winding arm, and—at the same time—said movable support carries, downstream of said outlet yarn guide eyelet, a double-leaf brake comprising an element opening the two leaves apart, an intermediate yarn guide eyelet, a weft tension device comprising an oscillating lever, and an end yarn guide eyelet, it can also be provided for the aforementioned actuators to be replaced by mechanical means, for instance simple fixed stops, which—following the movement of said support causing the outlet yarn guide eyelet to intersect the yarn trajectory—are apt to control said opening element of the double-leaf brake, as well as said oscillating lever of the weft tension device.

BRIEF DESCRIPTION OF THE DRAWINGS

The invention is now illustrated in further detail, with reference to the accompanying drawings, in which.

DETAILED DESCRIPTION OF THE PREFERRED EMBODIMENTS

Figure 1:
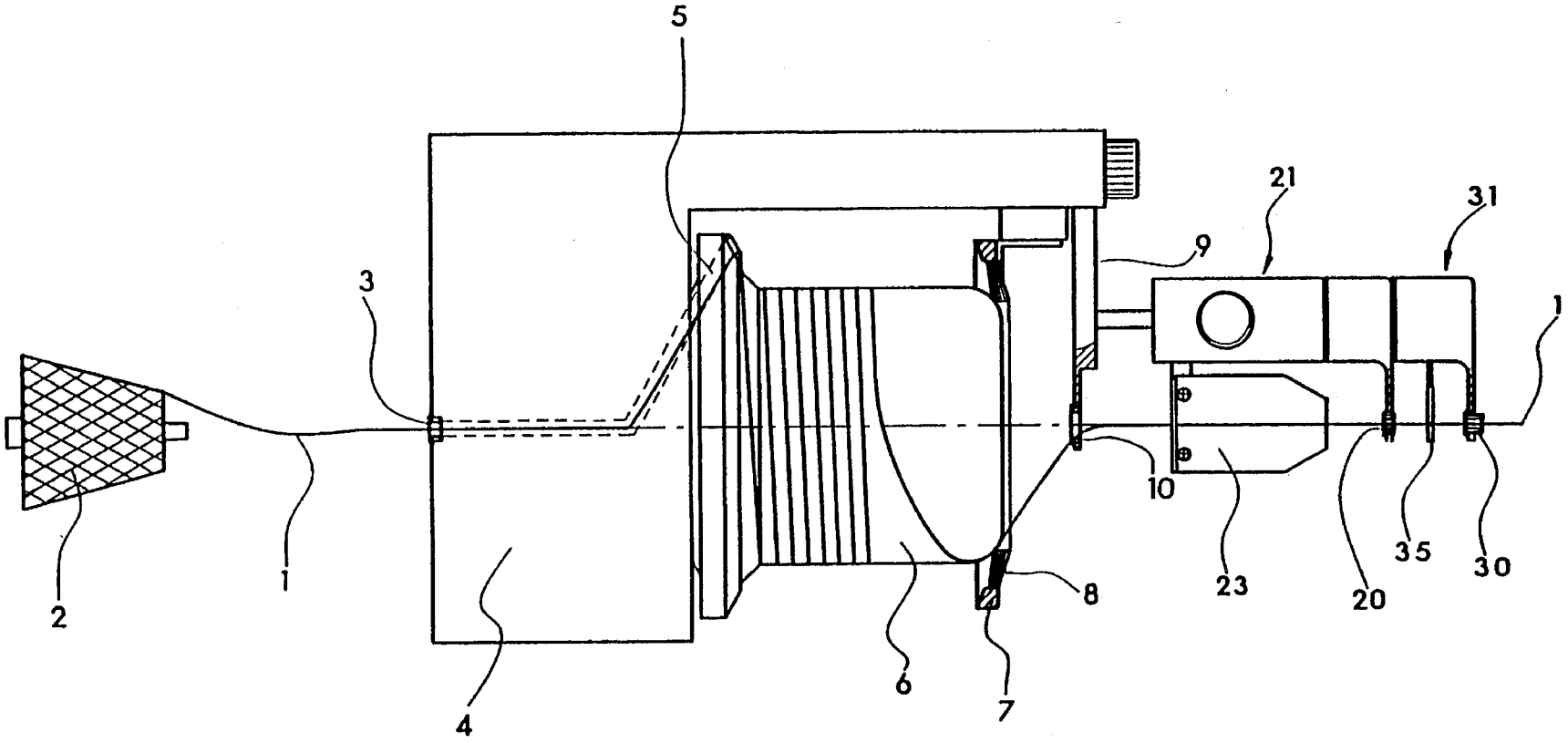
FIG. 1 PRIOR ART
FIG. 1 is a side assembly view of the general type of prior art weft feeder referred to in the introductory part of the description.
Figure 2:
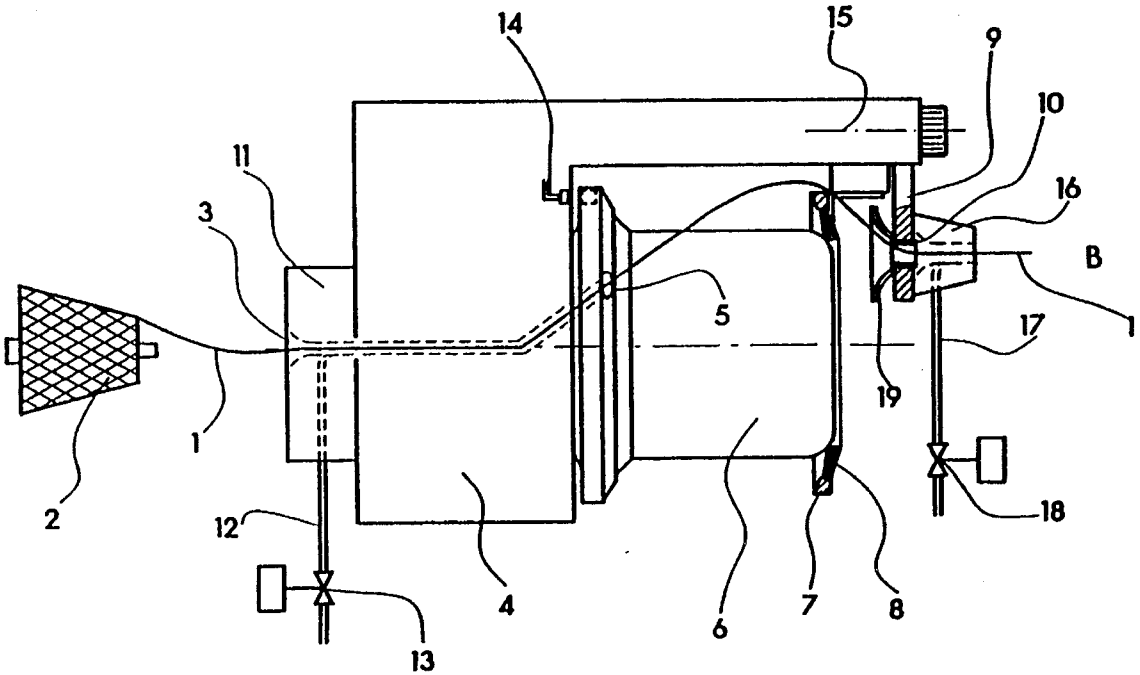
FIGS. 2 and 3 are a side view and, respectively, a front view from the outlet side, of a simplified embodiment of the weft feeder according to the invention.
Figure 3:
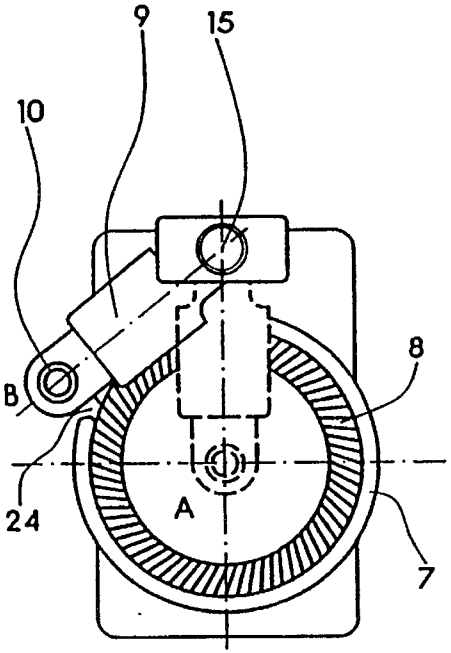

With reference first of all to FIGS. 2 and 3 of the drawings, it can be seen that a low-pressure nozzle 11, fed with air from a pipe 12 by means of an on-off valve 13, is applied upstream of the weft feeder according to the invention: the weft yarn 1, introduced through the conical inlet 3, is thus launched by an air jet into the inner cavity of the winding arm 5 which has been previously stopped in a fixed angular position, preset for example by means of an electromagnetic proximity switch 14. The movable support, consisting of a radial bracket 9 carrying the outlet yarn guide eyelet 10, is mounted on a pin 15 rotatable into an extension of the weft feeder body housing the motor 4, parallel to the axis of the drum 6, and can thus be shifted, by rotation, from a working position A to a position B (FIG. 3) in which the eyelet 10 intersects the trajectory of the weft yarn at its outlet from the inner cavity of the winding arm 5. To facilitate introducing the yarn into the eyelet 10, a lead-in mouthpiece in the form of a trumpet 19 can be provided in front of said eyelet 10, while a second compressed air nozzle 16 can be positioned downstream thereof: this latter nozzle 16, fed from a pipe 17 by means of an on-off valve 18, is apt to suck the weft yarn end into the trumpet 19.

With the eyelet 10 in position B, the weft yarn 1—in order to be introduced therein—travels externally to the ring 7 of the annular brush brake 8, as shown in FIG. 2. Thus, to make sure that the weft yarn winds around the drum surface when the bracket 9 is counter-rotated to move the eyelet 10 back into the working position A, a radial notching 24 (FIG. 3), suitably flared outwardly, is provided on the ring 7 so as to let the yarn through and allow its insertion under the brush brake 8, thanks to the actual rotation of the bracket 9 moving back to position A.

In the most simplified embodiment of the invention, the bracket 9 is manually rotated through a knob, but said rotation could obviously be controlled by a suitable pneumatic or electromechanical actuator.

Figure 4:
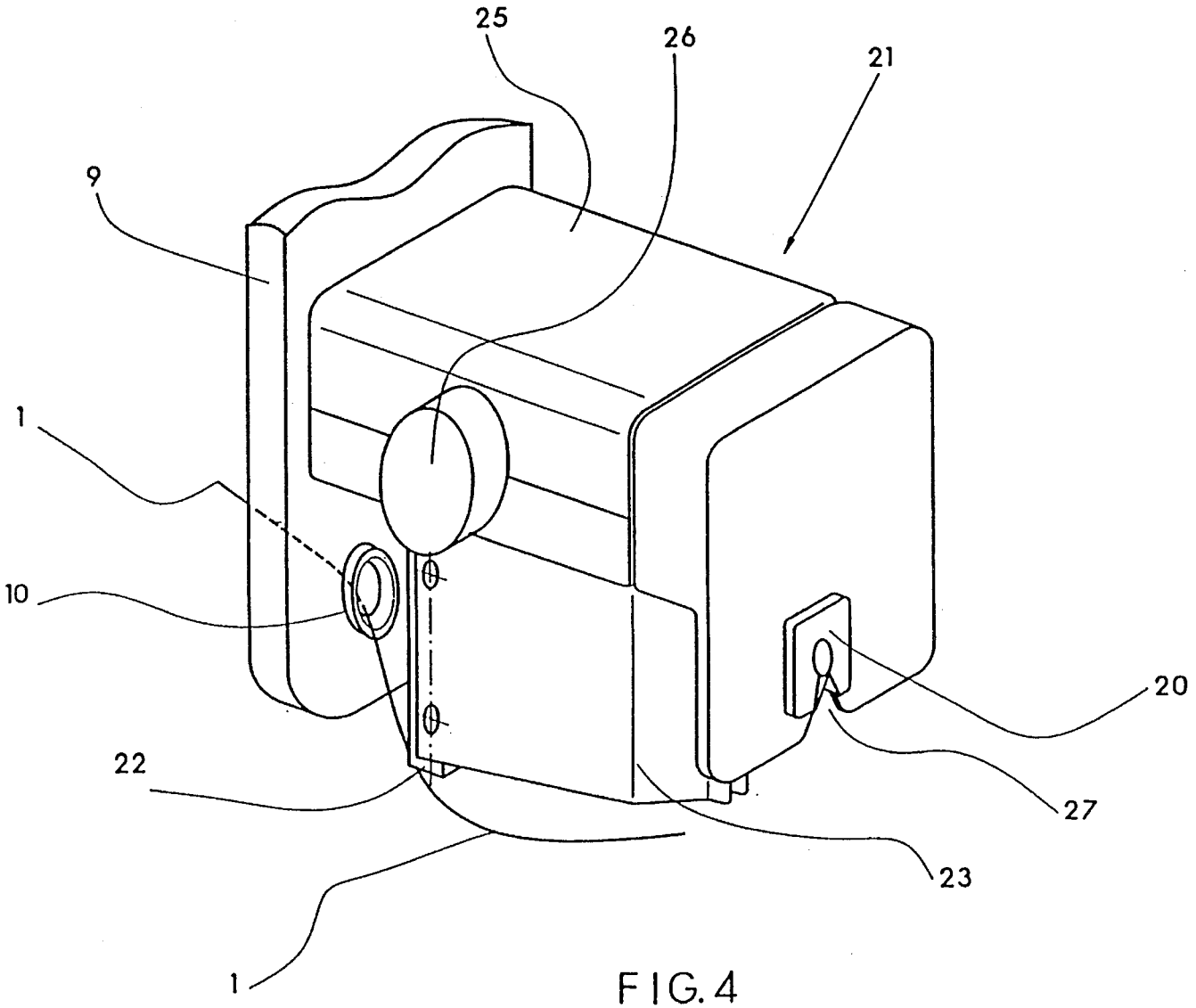
FIG. 4 is a perspective view of another simplified embodiment of the weft feeder according to the invention.

When the braking action of the annular brush brake 8 is not sufficient, said action is completed by a supplementary double-leaf brake 21, normally carried by said bracket 9 and positioned just downstream of the eyelet 10, as shown in FIG. 4. Said brake 21 consists of two elastic steel plates or leaves 23, carried by two pins 22 rotating about their own axes in opposite directions, so as to allow adjusting—by means of a knob 26—the mutual contact pressure between said two leaves 23. All these elements are mounted onto a support 25 comprising, at its outlet, a second yarn guide eyelet 20.

Once the weft yarn 1 has been inserted into the eyelet 10, as shown in FIG. 4, it can be very easily introduced by hand between the leaves 23 and also into the eyelet 20, if this latter eyelet is of the open type, namely of the type comprising a labyrinth-shaped radial notching 27, allowing the prompt insertion of the yarn while safely guiding it along its whole contour. With the arrangement of FIG. 4, since the notching 27 is positioned on the plane of the yarn trajectory and of the contact line between the two leaves 23, the introduction of the yarn into the eyelet 20 is simultaneous to its insertion between said leaves.

Figure 6:
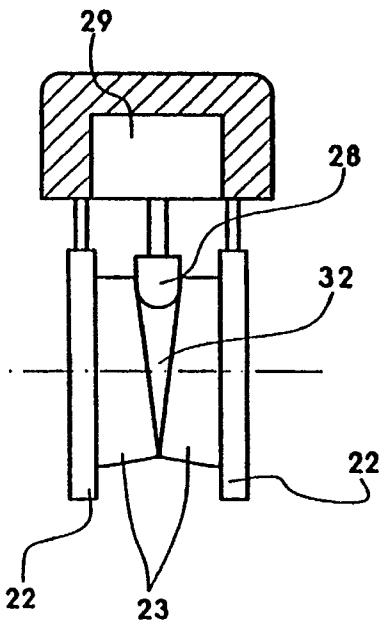
FIGS. 5 and 6 are, respectively, a partial side view, and a section view along the line VI—VI of FIG. 5, of a further embodiment of the weft feeder according to the invention.
Figure 5:
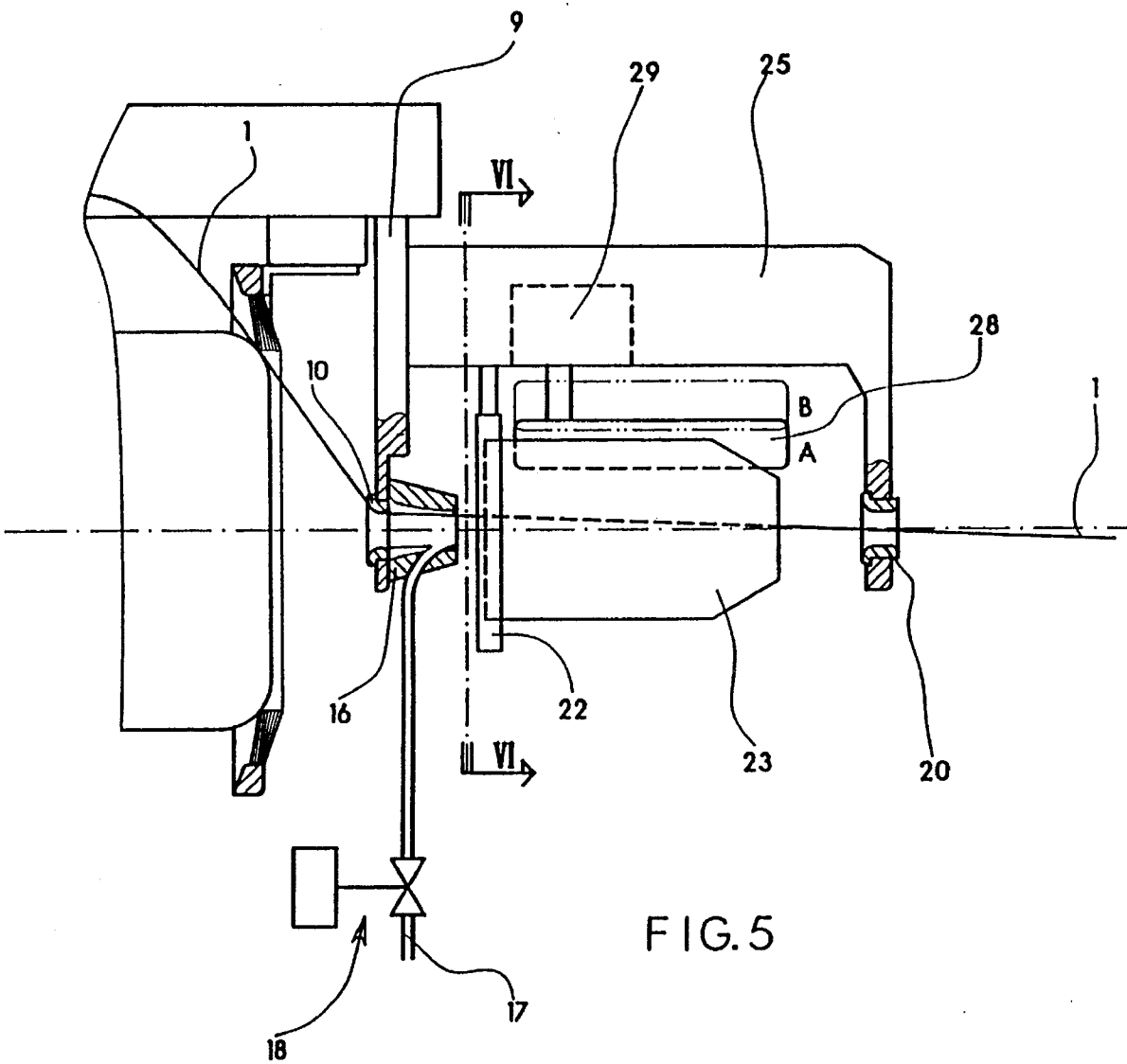

An improved solution according to the invention is shown in FIGS. 5 and 6, wherein the weft yarn 1 is pneumatically inserted into the double-leaf brake. Said solution consists in forming a duct for the yarn to be guided from the eyelet 10 to the eyelet 20, normally being in this case of the closed type. This duct is obtained by means of the compressed air suction nozzle 16, positioned just downstream of the eyelet 10—as already described heretofore—and by making use of a separating element 28 apt to part the two leaves 23, said separating element 28 having a wedge-shaped profile, best seen in FIG. 6, apt to penetrate between said two leaves 23 and open them apart parallely to the weft feeder axis. The separating element 28 is moved by an actuator 29—which can be of the pneumatic or electromechanical type—between a rest position B (dash-and-dot lines in FIG. 5), and a working position A in which the leaves 23 are apart: when in this position, the separating element 28 allows itself to form a closed guiding duct—of more or less triangular shape—the walls of which consist of said two leaves 23 and of the actual separating element 28, as shown by wedge 32 in FIG. 6. This duct allows the operator to obtain—with the same air jet—the simultaneous insertion of the weft yarn between the leaves 23 and through the eyelet 20 positioned downstream of the double-leaf brake 21.

Figure 8:
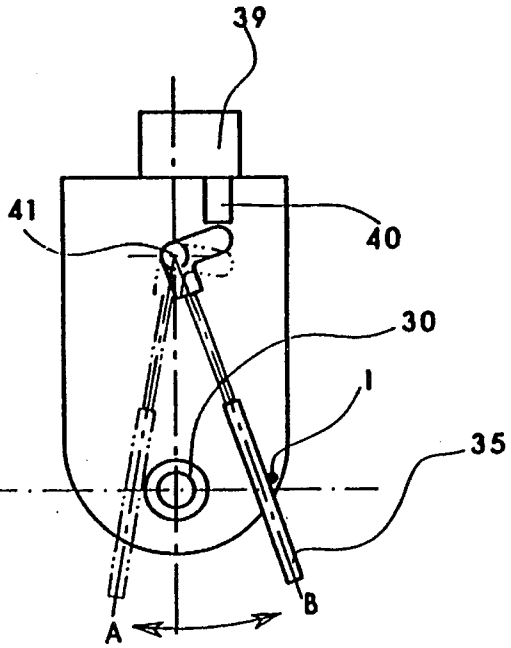
FIGS. 7 and 8 are, respectively, a partial side view, and a section view along the line VIII—VIII of FIG. 7, of a still further embodiment of the weft feeder according to the invention.
Figure 7:
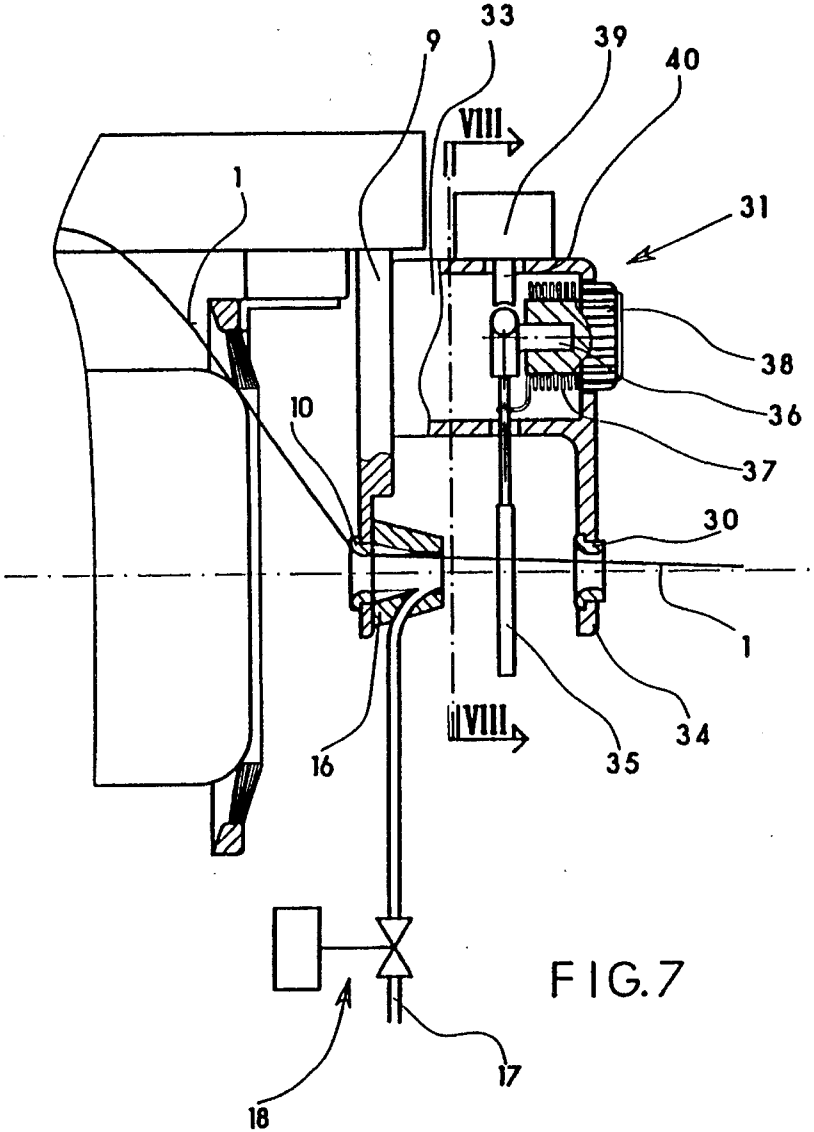

FIGS. 7 and 8 show a different embodiment of the weft feeder according to the invention, wherein the double-leaf brake is replaced by a weft tension device 31. This device 31 consists of a body 33, fixed to the same bracket 9 carrying the outlet yarn guide eyelet 10 followed by the compressed air suction nozzle 16. A third yarn guide eyelet 30 is mounted on the end part 34 of the body 33; between the two eyelets 10 and 30, there is interposed a lever 35, oscillating about a pin 36—parallel to the weft feeder axis—between two positions A and B (FIG. 8). In position B, the lever 35 is in working conditions, balanced between the force imparted by weft tension and that of a preloaded spring 37 acting thereon, which can be adjusted by means of a knob 38.

To insert the yarn 1 into the weft tension device 31 by means of a compressed air jet, it is necessary to shift back the lever 35 into position A (shown in dash-and-dot lines in FIG. 8); this shifting can be done by means of an actuator 39—of the pneumatic or electromechanical type—a movable pin 40 of which presses against an upper square appendix 41 of the lever 35, so as to rotate the lever 35 clockwise (FIG. 8) moving it to the left of the yarn trajectory.

Figure 9:
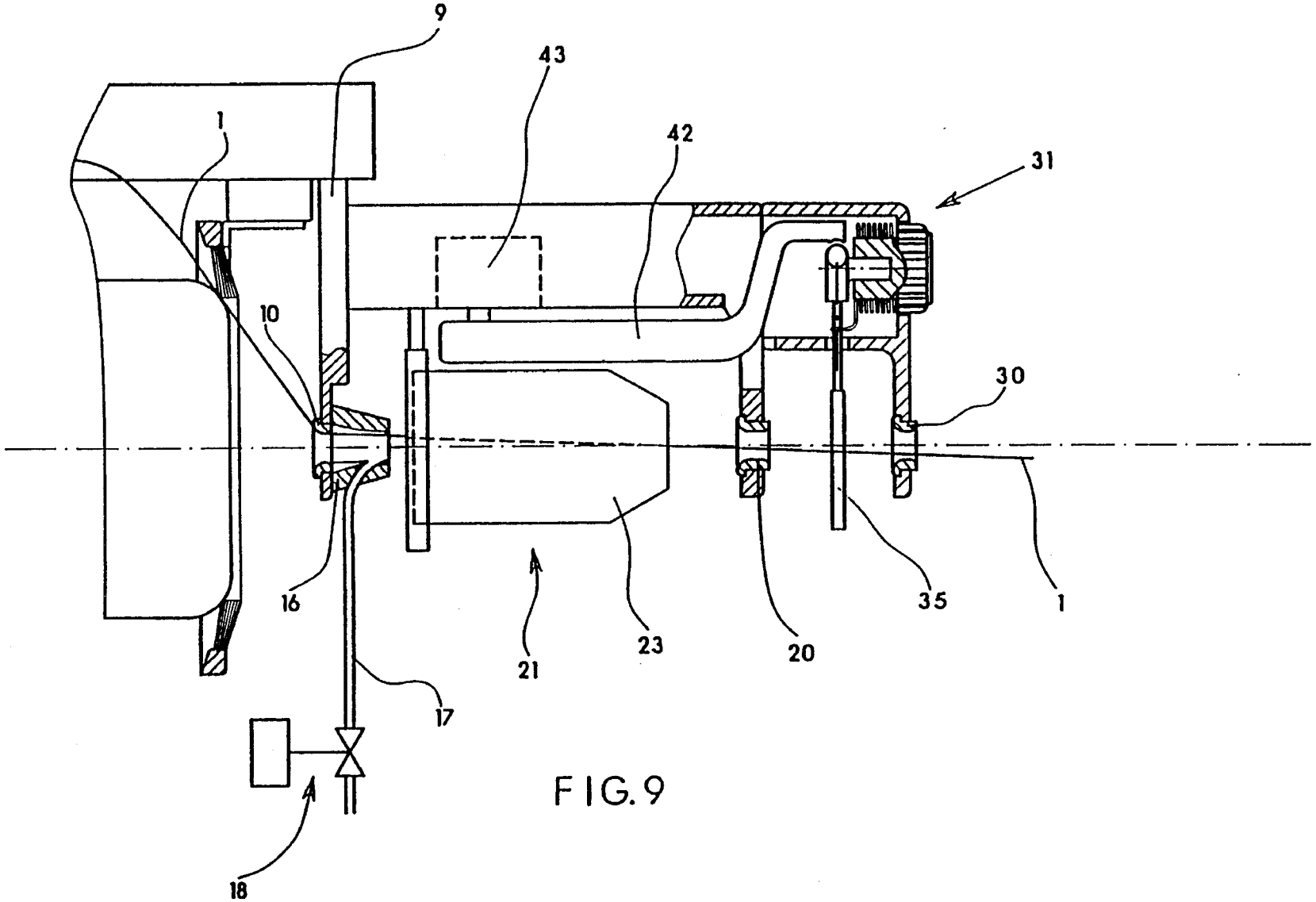
FIG. 9 is a partial side view of a fifth embodiment of the weft feeder according to the invention.

The most complete and improved embodiment of the weft feeder according to the invention—especially suited for gripper looms—is shown in FIG. 9. This embodiment combines, in succession, the two aforedescribed devices—namely the double-leaf brake 21 and the weft tension device 31 —which, in the other embodiments, are mounted separately. In this case, the forming of the duct between the two leaves 23—according to the principles set forth hereabove—allows the operator to guide the weft yarn 1 through the two successive eyelets 20 and 30, thanks to the air jet blown by the nozzle 16. A single rod 42, moved by an actuator 43, causes both the parting of the leaves 23—consequently forming said guiding duct—and the proper shifting of the lever 35 of the weft tension device 31.

According to another embodiment of the invention, it can also be provided—when the yarn is introduced through the outlet yarn guide eyelet 10 owing to rotation of the bracket 9, as previously described with reference to FIG. 3—for said rotation to simultaneously cause the shifting of the double-leaf brake 21 and of the weft tension device 31 from the working position A to the position B of yarn introduction shown in FIG. 3. In this case, simple fixed stops can be arranged in the yarn launching position B, to mechanically part the leaves 23 and shift the lever 35 following said rotation of the bracket 9, with no need to provide for any actuators.

I claim:

1. Weft feeder for gripper or projectile looms, comprising:

a body means for housing a motor;

a drum mounted on a motor shaft and held stationary, around which a winding arm rotated by the motor winds up a weft yarn reserve;

an extension of said body means carrying sensors to detect and control the weft yarn reserve being wound on the drum;

brake means, in the form of a ring with an annular brush, for braking weft yarn against an end surface of the drum;

pneumatic means for restoring the continuity of the weft yarn from a feed spool to a loom, in case of yarn breakage or interruption;

a first compressed air nozzle means, positioned at an inlet of the weft feeder, for introducing therein a new weft yarn fed from the feed spool; and yarn launching and guiding means for introducing the new weft yarn into a first yarn, guide eyelet centered on a longitudinal axis of the drum;

characterized in that, downstream of said first yarn guide eyelet (10), there are mounted a separating element (28, 42) to open apart two brake leaves (23) of a double-leaf brake (21), and a second yarn guide eyelet (20), said separating element (28, 42) being controlled by an actuator (29, 39, 43) so as to form a duct (32) to guide the weft yarn (1) from the first yarn guide eyelet (10) to the second yarn guide eyelet (20).

2. Weft feeder as in claim 1, wherein a weft tension device (31) is mounted downstream of the separating element (21), said weft tension device (31) having a third yarn guide eyelet (30) and an oscillating lever (35); and wherein the separating element (28, 42) is a rod (42) that likewise controls the oscillating lever (35) of the weft tension device (31).

3. Weft feeder as in claim 2, wherein said rod (42) has a wedge-shaped profile to penetrate between the two brake leaves (23) and open them apart.

4. Weft feeder as in claim 1, wherein a second compressed air nozzle means (16) for sucking the weft yarn (1) is provided immediately downstream of said first yarn guide eyelet (10).

* * * * *